US006623376B2

(12) United States Patent
Poynor

(10) Patent No.: US 6,623,376 B2
(45) Date of Patent: Sep. 23, 2003

(54) PEEN CONDITIONING OF TITANIUM METAL WOOD GOLF CLUB HEADS

(75) Inventor: Raymond Poynor, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/882,259

(22) Filed: Jun. 18, 2001

(65) Prior Publication Data

US 2002/0193177 A1 Dec. 19, 2002

(51) Int. Cl.[7] ..... A63B 53/04; C21D 7/06

(52) U.S. Cl. ..... 473/342; 473/330; 473/345; 148/516

(58) Field of Search ..... 473/342, 330, 473/331, 329; 273/78, 167; 148/516, 206, 211

(56) References Cited

U.S. PATENT DOCUMENTS

| | | | | |
|---|---|---|---|---|
| 5,226,652 A | | 7/1993 | Sato | 273/80.2 |
| 5,409,415 A | | 4/1995 | Kawanami et al. | 451/39 |
| 5,487,543 A | | 1/1996 | Funk | 273/78 |
| 5,624,329 A | | 4/1997 | Schneebeli | 473/287 |
| 5,779,560 A | * | 7/1998 | Buck et al. | |
| 5,916,383 A | | 6/1999 | Rokutanda et al. | 148/516 |
| 6,183,381 B1 | * | 2/2001 | Grant et al. | |

OTHER PUBLICATIONS

Dwayne D. Arola et al., "Abrasive Waterjet Peening: A New Method of Surface Preparation for Metal Orthopedic Implants," *J. Biomed. Mater. Res.* (*Appl. Biomater.*), vol. 53 (2000): 536–546.

The Theory of Shot Peening, http://www.shotpeening.com/shot_peening_theory.htm, Sep. 14, 2000, 1 page.

William Braisted et al., "Finite element simulation of laser shock peening," *International Journal of Fatigue*, vol. 21 (1999): 719–724.

ASM Handbook, vol. 20, Materials Selection and Design, 1997, pp. 399–404.

B. R. Sridhar et al., "Effect of shot peening on the fatigue and fracture behavior of two titanium alloys," *Journal of Materials Science*, vol. 31 (1996): 5953–5960.

L. Wagner et al., "Thermomechanical Surface Treatment of Titanium Alloys," *Materials Science Forum*, vols. 163–165 (1994): 159–172.

Al–Ti, Jul., 1992, 2 pages.

Michael B. Bever, Ed., Encyclopedia of Materials Science and Engineering, vol. 7, Pergamon Press (1986), pp. 5099–5106.

Ti–V, Jul., 1983, 2 pages.

S.R. Seagle et al., "Physical Metallurgy and Metallography of Titanium Alloys," in Titanium and Titanium Alloys Source Book, ASM, (1982), pp. 23–32.

Albert G. Guy et al., Elements of Physical Metallurgy, Third Edition, Addison–Wesley Publishing Company, 1974, pp. 357–360.

Max Hansen et al., Constitution of Binary Alloys, Second Edition, McGraw–Hill Book Company Inc., 1958, pp. 139–142, 1240–1242.

* cited by examiner

*Primary Examiner*—Paul T. Sewell
*Assistant Examiner*—Thanh Duong
(74) *Attorney, Agent, or Firm*—Swidler Berlin Shereff Friedman, LLP

(57) ABSTRACT

A golf club head is provided with a residual compressive stress layer on the inside surface of the club face using a peening treatment. The peening treatment also may remove material from the club head, such as unwanted alpha case on a titanium club head. The body of the club head further may be subjected to a peen treatment.

29 Claims, 2 Drawing Sheets

PEEN CONDITIONING OF TITANIUM METAL WOOD GOLF CLUB HEADS

FIELD OF THE INVENTION

The invention relates to a method of forming a compressive layer on a golf club head. More particularly, the invention relates to peening of surfaces, such as shot peening the inner surface of a club head and face, as well as a club head so formed.

BACKGROUND OF THE INVENTION

Various golf club designs have been introduced in the marketplace to address the desire for equipment that has a long service life. In particular, manufacturers have produced club heads from a range of materials including metals and alloys such as stainless steel, aluminum, and titanium. In addition, club heads with variable face thickness have been developed, so that the stresses associated with the impact of a golf ball with a club face may be properly managed.

Titanium alloys typically used for golf club head manufacture include 6-4 (Ti-6% Al-4% V), due to its high strength to density ratio and stiffness (modulus of elasticity), and 15-3-3-3 (Ti-15% V-3% Cr-3% Al-3% Ni). Club faces may also be cold forged or stamped from as-rolled sheet stock of high strength SP-700 titanium alloy (Ti-4.5% Al-3% V-2% Mo-2% Fe). In addition, the face can be formed of a high strength forging titanium alloy such as 10-2-3 (Ti-10% V-2% Fe-3% Al). Typical face thicknesses for titanium alloy metal woods range from about 0.118 to 0.126 inches.

It is desirable to decrease the thickness of the face of the club head in order to redistribute the weight elsewhere within the head. However, there are limitations on the degree of thinness of the club face, as a function of the face material and treatment. For example, a club face that is too thin may be susceptible to catastrophic failure during impact, as it may be unable to withstand the impact stresses. Failure may occur, for example, proximate the impact region, as well as proximate high stress concentration zones such as scorelines. In addition, the fatigue life of a given club head may be decreased as a result of the thin club face, which may lead to premature failure of the club head after repeated stressing. Variable face thickness addresses some of the problems inherent with thin face designs; by providing an area of increased thickness proximate the center of the face, where ball impacts are intended to occur, a stronger club head may be obtained so that the stresses of impact do not affect the integrity of the club head. Adjacent regions may have reduced thickness as compared to the central region of the face, so that weight may be redistributed in the club head.

Mechanical and chemical surface treatments have long been used in golf club manufacturing to produce club heads with high quality, finished, exterior surfaces. The treatments, including shot peening, are typically used for aesthetic conditioning, i.e. creating exterior surfaces with a desirable look and feel, such as by cleaning or selectively roughening or smoothing the surface. The surfaces of some iron golf clubs from Taylor Made, Callaway, and Ping have been finished with shot peening. For example, Taylor Made's ICW-11 irons, produced during the 1980s, were treated with shot peening. In addition, the stainless steel heads of Wilson Power Chamber metal wood golf clubs were shot peened on their outer surface. Although shot peening treatments have become accepted methods of conditioning the exterior of club heads, a drawback to such treatments is that the peening media may penetrate the club head in thin areas that cannot withstand the repeated, focused impacts.

U.S. Pat. No. 5,487,543 to Funk discloses a shot peened golf club head. The exposed ball striking surface of a golf iron club head is subjected to a very high intensity shot peening to develop an increase in hardness and a compressive stress on the surface. The shot peening is used to work harden the club head face and develop a compressive stress on the surface by cold working.

Despite these developments, there exists a need for an improved golf club head with a compressive layer on the inner surface of the club face. More particularly, there is a need for a golf club head with a compressive layer on the inner surface of the club face that is formed by peening the inner surface.

SUMMARY OF THE INVENTION

The invention is related to a metal wood golf club head including a body and a front face having an inner surface and an outer surface, wherein a substantial portion of the inner surface is treated to have a residual compressive stress. The portion of the inner surface is peened by shot peening, laser peening, or abrasive waterjet peening. The portion of the inner surface of the front face has a first thickness before being peened and a second thickness after being peened, and the second thickness is less than the first thickness. The face may be cast or stamped sheet metal. In one embodiment, the portion of the front face is about 0.11 inch thick or less, and in another embodiment the portion of the front face is about 0.10 inch thick or less. The portion may include about 60% or more of the inner surface of the front face in some embodiments, and the portion may include about 80% or more of the inner surface of the front face in other embodiments. A substantial portion of the outer surface of the face is peened, with the substantial portion of the outer surface including about 60% or more of the outer surface in some embodiments and about 80% or more of the outer surface in other embodiments. A portion of the body adjacent to the outer surface may be peened, and the inner surface and a portion of the body adjacent the face may be peened. The face may be formed of titanium, with the body formed of titanium or steel. In another embodiment, the face is formed of steel, and the body is formed of titanium or steel.

The present invention also is related to a method of treating a metal wood golf club head including peening an inner surface of the club head, whereby the inner surface is provided with a residual compressive stress. The club head may include a body and a front face having a face thickness, and the inner surface may include a substantial portion of an inner surface of the front face. The portion may include about 60% or more of the front face in one embodiment, and the portion may include about 80% or more of the front face in another embodiment. The method may further include substantially decreasing the face thickness, and a substantial amount of alpha case may be removed from an inner surface of the front face of the club head. Between about 30 percent and about 90 percent of alpha case, continuous and discontinuous, may be removed from a central region of the inner surface of the front face. The method also may include peening an outer surface of the club head.

The present invention further is related to a front face for a metal wood golf club head, including an inner surface and an outer ball-striking surface, wherein a substantial portion of the inner surface is treated to have a residual compressive stress.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENTS

The present invention is directed to a golf club head with an inner surface that has been peened. Preferably, the inner surface of the face is treated, as well as inner regions generally adjacent to the face. The club head is preferably formed from a titanium alloy, due to the high strength and low weight of the metal, and the peening is preferably shot peening although other peening methods such as laser shock peening and abrasive water jet peening may be employed.

Figure 1:
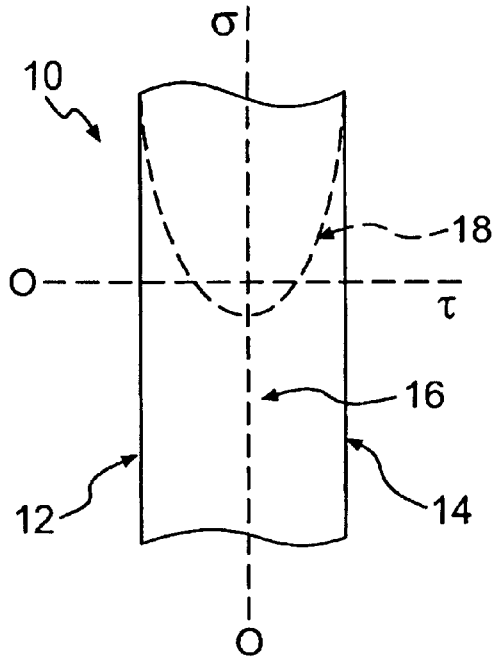
FIG. 1 PRIOR ART
FIG. 1 shows a side view of prior art tempered glass with a stress curve superimposed thereon.

Peen treatments preferably are used to increase the hardness and residual compressive stresses of a golf club head. In principle, the formation of a compressive layer is similar to the manufacture of tempered glass. For example, as shown in FIG. 1, a prior art glass plate 10 may be heated and then quickly cooled by an air or oil quench. Due to the sudden drop in temperature, the surfaces 12, 14 of glass plate 10 contract and become rigid. The center 16 of glass plate 10, however, remains hot and adjusts to the dimensional constraints imposed by the outer "skin" or surface layers, i.e., the contraction of the surface layers. Advantageously, when the center 16 is finally cooled, and itself slightly contracts, residual compressive stresses remain at and near the surfaces 12, 14, while tensile stresses are present at and near the center 16 of glass plate 10. An exemplar representation of the stress, $\sigma$, as a function of distance, t, from the center 16 of the glass, is superimposed on glass plate 10 in FIG. 1, with compressive stresses along curve 18 represented in the positive direction on the $\sigma$ axis and tensile stresses represented in the negative direction.

Due to the stress state shown in FIG. 1, a significant deflection of glass plate 10 must occur before a sufficient tensile stress can develop at its surface, the location from which a crack would propagate, to result in failure. While such prestressed, tempered glass may withstand significantly higher tensile stresses and impacts than untempered glass, scratching a surface of glass plate 10 can create a localized region in which sufficient tensile stress may be developed, at a much lower deflection, to still permit rapid crack propagation at the location of the scratch. In general, under uniform loading, tempered glass is about four times stronger than annealed glass of the same size and thickness. This increased strength provides enhanced resistance to cyclical loading, impacts, and other stresses.

Figure 2:
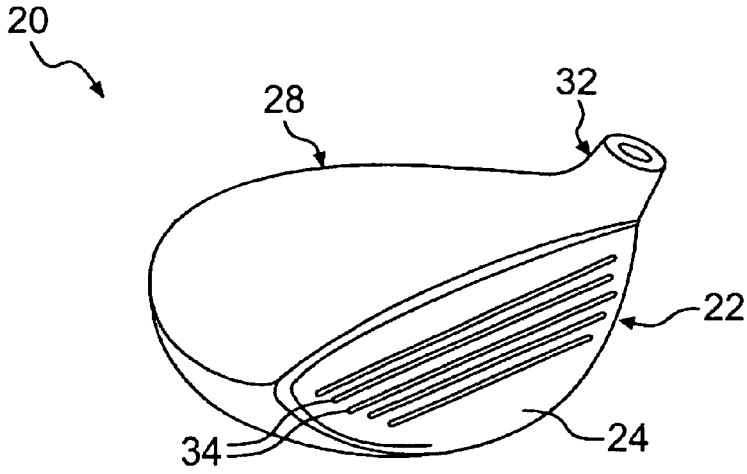
FIG. 2 shows a perspective view of a golf club head of the present invention.
Figure 3:
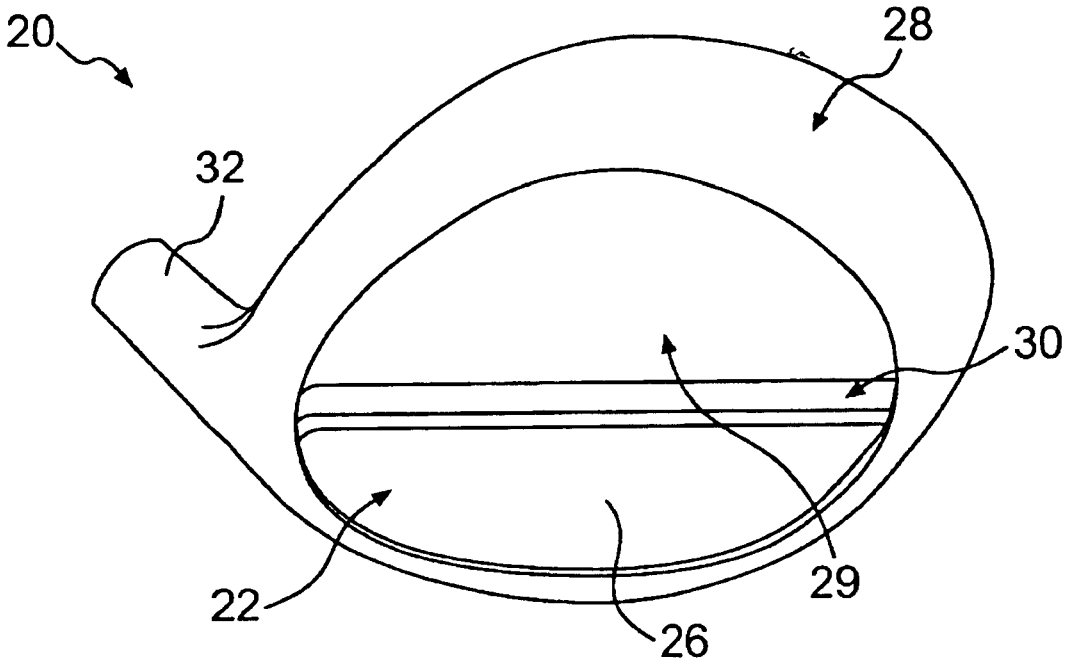
FIG. 3 shows a partial cross-sectional view of the club head of FIG. 2 including the back portion of the face.

Turning now to FIGS. 2 and 3, a golf club head 20 according to the present invention is shown. Golf club head 20 has a front face 22 with an outer, striking surface 24 and an inner, back surface 26, as well as a body 28 forming a cavity 29. Body 28 can be a single piece or multiple pieces and may include a sole plate or a crown plate. In addition, each of face 22 and body 28 may be cast, forged, stamped, or formed in some other manner. Face 22 may further include a perimetral weighting region 30 on back surface 26, extending around at least a portion of the periphery of face 22. Face 22 and body 28 may be a single component, or separate components to be welded together or otherwise attached to form head 20. A hosel 32 also is provided for facilitating attachment of a shaft to club head 20.

In the preferred embodiment, golf club head 20 is formed of titanium through an investment casting process. During the investment casting of titanium to form a club head 20, a ceramic shell of suitable shape is filled with molten metal. Although the ceramic shell is typically formed of special refractory oxides to generally minimize reactions with the molten metal, often some of the metal still reacts with the shell due to titanium reduction of the ceramic oxides. During formation of club head 20 from a 6-4 alloy, for example, the oxygen-rich surface of the casting stabilizes the alpha ($\alpha$) phase of the alpha-beta ($\alpha+\beta$) alloy, resulting in the formation of an alpha "case" layer on the cast surfaces. The $\alpha$-case is typically subsequently removed from the outer cast surface by a process such as chemical milling or polishing. Continuous regions of $\alpha$-case may be about 3 to 4 thousandths of an inch deep from the surface of the club head 20, while discontinuous regions may be as much as 8 thousandths of an inch deep. The reaction of the metal with the mold may also cause subsequent diffusion of the reaction products inward from the cast surface. This diffusion is dependent on time and temperature and varies as a function of the thickness of the section.

Alpha case is undesirable because of the micro-cracking present in this layer, i.e., tiny cracks and discontinuities that can be the source of failure. Thus, to avoid the problems associated with $\alpha$-case formation and reaction product diffusion, the areas of the club head 20 where this is likely to occur can be made with greater thickness so that the micro-cracking extends through a smaller percentage of the cross-section. Alternatively, chemical or mechanical milling or polishing can be used to remove the $\alpha$-case. However, some regions of the face 22 of club head 20 are not typically processed. For example, the score lines 34 are cast in place to a depth of about 25 thousandths of an inch. While subsequent polishing of face 22 may decrease the depth of score lines 34 to about 20 thousandths of an inch, $\alpha$-case inside the recessed area of the score lines 34 is often not removed by the polishing operation. Back surface 26 of face 22 is another region where $\alpha$-case is often present, because back surface 26 is not typically polished. Welding near $\alpha$-case, such as to couple a separate face 22, body 28, crown plate, and/or sole plate, additionally may cause micro-cracks to propagate due to the localized heating. Due to the presence of $\alpha$-case on both score lines 34 and back surface 26, these regions may serve as regions of club head weakness and eventual failure.

Thus, a titanium golf club head 20 according to the present invention is subjected to a peening treatment whereby back surface 26 of club head 20 is peened to create a layer with a residual compressive stress. Preferably, shot peening is employed to provide a compressive stress layer sufficient to withstand the tensile stresses created by impact of a golf ball with face 22. More preferably, the layer is formed having a compressive stress that is at least as great as the tensile stress due to impact with the golf ball. Impact of a golf ball with face 22 is known to typically produce a force of between about 2000 pounds and about 5000 pounds. It is also known that impact may result in compression of the golf ball by as much as thirty percent. Preferably, the compressive stress is at least as great as about sixty percent of the yield stress of a typical golf ball, which is about 62 MPa. In a preferred embodiment, the compressive stress layer is about 37 MPa at a surface of face 22. In alternate embodiments, other compressive stresses of greater or lower magnitudes may be used; any residual compressive stress of back surface 26 advantageously counteracts tensile stresses generated by impact. Residual stresses exceeding 500 MPa may be produced by shot peening of titanium. The compressive layer formed on back surface 26 by shot peening also may reinforce scorelines 34, decreasing concern for failure in these regions.

As also described above, shot peening of back surface 26 of a titanium golf club head 20 according to the present invention may remove undesirable α-case. Such a treatment advantageously decreases the need for chemical milling or other mechanical treatments to remove the α-case, which also may be relatively inaccessible particularly to mechanical milling due to the shape of club head 20. Removal of α-case may permit the production of a club head 20 with a face 22 that is thinner than otherwise permitted, so that club head weight may be redistributed. In one preferred embodiment, face 22 is cast. After peening, face 22 is less than about 0.11 inch thick. More preferably, face 22 is less than about 0.10 inch thick after peening. In one embodiment, about 60% or more of face 22 is provided with such thickness, and in another embodiment about 80% or more of face 22 is provided with such thickness. Removal of microcrack regions may significantly increase fatigue life of club head 20 as well. Thus, the removal of α-case from a casting may provide a cast club head 20 with comparable stress behavior to a forged club head 20. Shot peening, in general, may be used to remove unwanted material from a surface of club head 20.

In one embodiment, between about 30 percent and about 90 percent of alpha case is removed from the central region of the back surface 26 of a face 22.

Preferably, club heads 20 formed according to the present invention approach the target coefficient of restitution of 0.829 (for a relative velocity of 160 ft/sec), which corresponds to the regulated value established by the United States Golf Association.

As mentioned above, a separate face 22, body 28, crown plate, and/or sole plate may be coupled by welding to form a club head 20, but regions at and near such welding may have increased susceptibility to failure due to microcracking in the α-case. Thus, the present invention contemplates peen treatment of regions inside body 28 adjacent back surface 26 of face 22. Perimetral weighting region 30 on back surface 26, extending around at least a portion of the periphery of face 22, maybe subjected to shot peening to remove α-case as well as provide the desired magnitude of compressive stress.

While the present invention has been discussed with respect to peen treatments of back surface 26 of face 22 and surrounding areas, other areas of club head 20 also may be similarly treated. For example, body 28 may be peen treated, including hosel 32. The inside and outside of body 28 may be treated. The ball striking surface 24 may be peen treated as well, for example, to remove α-case. In one embodiment, about 60% or more of ball striking surface 24 is peen treated, and in another embodiment about 80% or more of ball striking surface 24 is peen treated.

In one embodiment of the present invention, golf club head 20 is formed of a 6-4 titanium alloy (Ti-6% Al-4% V). Advantageously, the fatigue limit (otherwise known as the endurance limit) may be improved by subjecting club head 20 to shot peening. In theory, the fatigue limit is the stress level below which an infinite number of cycles can be sustained without failure. Thus, according to the present invention, a suitable amount of shot peening is used to produce a sufficient residual compressive stress, whereby a high enough fatigue limit is reached to effectively handle anticipated impact stresses during golf ball impacts with club face 22.

Among the factors to be considered when producing a golf club head 20 according to the present invention with shot peening include the type of titanium alloy, required heat treatment(s), any surface treatments that accompany the shot peening such as electropolishing or machining and polishing, peening pressure and distance of peening from the surface to be peened, as well as shot peen media characteristics, i.e., media size, material, hardness, and distance from the face surface.

Peening treatments other than shot peening also may be employed to create a residual compressive layer and/or remove α-case on a surface of golf club head 20. Laser shock peening, for example, may be used. The surface to be peened is coated with paint and a thin film of water. A single pulse of a high energy laser beam is aimed at a particular spot on the material. The beam passes through the water and causes the paint to vaporize into a plasma, and when the plasma expands, high pressure shock waves propagate through the water and into the metal. The water confines the energy and increases the intensity of the pulse. Favorable compressive residual stresses may be produced because the pressure pulse on the surface of the metal can exceed twice the dynamic yield strength, resulting in plastic deformation at the surface.

Another method of forming a compressive layer on a surface of golf club head 20 is abrasive waterjet peening. A high pressure abrasive laden waterjet is sprayed onto the surface where the compressive layer is to be formed. The water source may be propelled at pressures of about 50 to about 300 MPa. Impingement of the waterjet on the surface causes localized erosion and deformation on the surface of the metal.

In some embodiments of the present invention, materials other than titanium are employed. Although such materials may not have undesirable α-case, the peening treatment may nevertheless produce desirable compressive stresses. In addition, removal of material other than α-case may be accomplished with such a peening treatment. Thus, the present invention also contemplates peening of steels such as stainless steel, as well as aluminum and other materials.

In some embodiments, the peen treatment first may be performed prior to securing a separate face 22, body 28, crown plate, and/or sole plate After the components are attached, the peripheral areas of the components may again be peened through an opening in body 28 provided for a sole plate or crown plate, or through a window provided in body 28.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, a club head 20 may be formed of different materials such as a titanium face 22 and a steel body 28, one or more portions of which may be subjected to a peen treatment. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A metal wood golf club head comprising:

a body; and a front face having an inner surface and an outer surface, wherein the inner surface has a first amount of α-case, and wherein a substantial portion of the inner surface is treated to have a residual compressive stress and a second amount of α-case less than the first amount.

2. The club head of claim 1, wherein the portion of the inner surface is peened.

3. The club head of claim 2, wherein the portion of the inner surface is shot peened.

4. The club head of claim 2, wherein the portion of the inner surface is laser peened.

5. The club head of claim 2, wherein the portion of the inner surface is abrasive waterjet peened.

6. The club head of claim 2, wherein the portion of the inner surface of the front face has a first thickness before being peened and a second thickness after being peened, and the second thickness is less than the first thickness.

7. The club head of claim 2, wherein the face is cast.

8. The club head of claim 7, wherein the portion is about 0.11 inch thick or less.

9. The club head of claim 8, wherein the portion comprises about 60% or more of the inner surface of the front face.

10. The club head of claim 8, wherein the portion comprises about 80% or more of the inner surface of the front face.

11. The club head of claim 7, wherein the portion is about 0.10 inch thick or less.

12. The club head of claim 11, wherein the portion comprises about 60% or more of the inner surface of the front face.

13. The club head of claim 11, wherein the portion comprises about 80% or more of the inner surface of the front face.

14. The club head of claim 2, wherein the face is stamped sheet metal.

15. The club head of claim 2, wherein a substantial portion of the outer surface of the face is peened.

16. The club head of claim 15, wherein the substantial portion of the outer surface comprises about 60% or more of the outer surface.

17. The club head of claim 15, wherein the substantial portion of the outer surface comprises about 80% or more of the outer surface.

18. The club head of claim 15, wherein a portion of the body adjacent to the outer surface is peened.

19. The club head of claim 1, wherein the inner surface and a portion of the body adjacent the face are peened.

20. The club head of claim 1, wherein the face is titanium.

21. The club head of claim 20, wherein the body is titanium.

22. The club head of claim 20, wherein the body is steel.

23. The club head of claim 1, wherein the face is steel.

24. The club head of claim 23, wherein the body is titanium.

25. The club head of claim 23, wherein the body is steel.

26. The front face of claim 24, wherein the outer ball striking surface is peened.

27. A front face for a metal wood golf club head, comprising an inner surface and an outer ball-striking surface, wherein the inner surface has α-case, and wherein a substantial portion of the inner surface is treated to have a residual compressive stress and to remove about 30 percent to about 90 percent of the α-case.

28. The front face of claim 27, wherein the inner surface is peened.

29. The front face of claim 28, wherein the inner surface is shot peened, laser peening, abrasive water jet peened, or a combination thereof.

* * * * *